US005990794A

United States Patent [19]

Alicot et al.

[11] Patent Number: 5,990,794

[45] **Date of Patent: *Nov. 23, 1999**

[54] APPARATUS FOR DATA COMMUNICATION AND DEACTIVATION OF ELECTRONIC ARTICLE SURVEILLANCE TAGS

[75] Inventors: Jorge F. Alicot, Davie; Richard B. Frederick, Lighthouse Point; Scott A. Tribbey, Coconut Creek; Hubert A. Patterson, Boca Raton, all of Fla.

[73] Assignee: Sensormatic Electronics Corporation, Boca Raton, Fla.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/721,175

[22] Filed: Sep. 26, 1996

[51] Int. Cl.[6] ..... G08B 23/00

[52] U.S. Cl. ..... 340/573.1; 235/383; 340/572.1

[58] Field of Search ..... 340/572.1, 551, 340/521, 522, 573.1; 235/383

[56] References Cited

U.S. PATENT DOCUMENTS

| | | | |
|---|---|---|---|
| 4,084,742 | 4/1978 | Silverman | 235/383 |
| 4,413,254 | 11/1983 | Pinneo et al. | 340/572 |
| 4,829,397 | 5/1989 | Veraikov et al. | 361/149 |
| 5,005,125 | 4/1991 | Farrar et al. | 364/403 |
| 5,059,951 | 10/1991 | Kaltner | 340/572 |
| 5,210,524 | 5/1993 | Schwarz et al. | 340/572 |
| 5,258,766 | 11/1993 | Murdoch | 340/572 |
| 5,260,690 | 11/1993 | Mann et al. | 340/572 |
| 5,392,028 | 2/1995 | Pichl | 340/572 |
| 5,410,296 | 4/1995 | Montbriand et al. | 340/572 |
| 5,469,142 | 11/1995 | Bergman et al. | 340/572 |
| 5,500,640 | 3/1996 | Zhou et al. | 340/572 |
| 5,705,986 | 1/1998 | Zschirnt | 340/572 |
| 5,710,540 | 1/1998 | Clement et al. | 340/572 |

FOREIGN PATENT DOCUMENTS

| | | | |
|---|---|---|---|
| 0703552 A1 | 3/1996 | European Pat. Off. | G08B 13/24 |

*Primary Examiner*—Daniel J. Wu
*Assistant Examiner*—John Tweel, Jr.
*Attorney, Agent, or Firm*—Paul T. Kashimba

[57] ABSTRACT

An apparatus for data communication and deactivating an electronic article surveillance tag comprising an antenna for communicating with a transponder located within a predetermined area and a deactivation coil for deactivating an electronic article surveillance tag located within the predetermined area.

20 Claims, 4 Drawing Sheets

APPARATUS FOR DATA COMMUNICATION AND DEACTIVATION OF ELECTRONIC ARTICLE SURVEILLANCE TAGS

FIELD OF THE INVENTION

This invention relates to electronic article surveillance and, more particularly, to data communication and deactivation of electronic article surveillance tags.

BACKGROUND OF THE INVENTION

Electronic article surveillance (EAS) systems have employed either reusable EAS tags or disposable EAS tags to monitor articles to prevent shoplifting and unauthorized removal of articles from store. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices use coils which are energized to generate a magnetic field of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally coplanar with the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk places a bag or bulk container into the cavity and then places the tagged articles into the bag. After all of the articles have been placed into the bag or when the bag is full, the clerk energizes the coils to deactivate all of the EAS tags in the bag. The clerk then lifts the bag out of the cavity. This system provides deactivation of multiple tags at one time and does not require specific orientation of the tags.

Many retail establishments having high volumes find it desirable to expedite and facilitate the checkout process including the gathering of data about the article being purchased and the deactivation of the EAS tags. The data required by many retailers includes article identification, the price of the article, and other information for inventory control. The bar code labels in current use are limited in the amount of data that can be provided, and the checkout clerk can have difficulties getting the proper line of sight between the bar code label and bar code scanner thereby slowing the checkout process.

SUMMARY OF THE INVENTION

In accordance with the present invention there is provided an apparatus for data communication and deactivation of an electronic article surveillance tag. The apparatus comprises an antenna positioned for communication with a transponder located within a predetermined area, and a deactivation coil for deactivating an electronic article surveillance tag located within the predetermined area.

The system of the present invention includes EAS deactivation and information gathering for the point of sale transaction to provide a complete solution to expedite retail checkout. High frequency radio frequency identification (RFID) tags are easily shielded or detuned by proximity to various materials and the human body, and RFID tags having small coil geometry do not provide the wide exit EAS coverage that retailers desire. However, the RFID tags are well suited to providing data about the article to which they are attached and are well suited to an expedited gathering of that data at the point of sale. In addition, data can be written to the RFID tag which can include the date and place of sale, the selling price, and the manufacturer for authenticity of the article. An EAS tag provides the security needed by the retail environment.

Other objectives, advantages, and applications of the present invention will be made apparent by the following detailed description of the preferred embodiment of the invention.

DETAILED DESCRIPTION OF PREFERRED EMBODIMENTS

Figure 1:
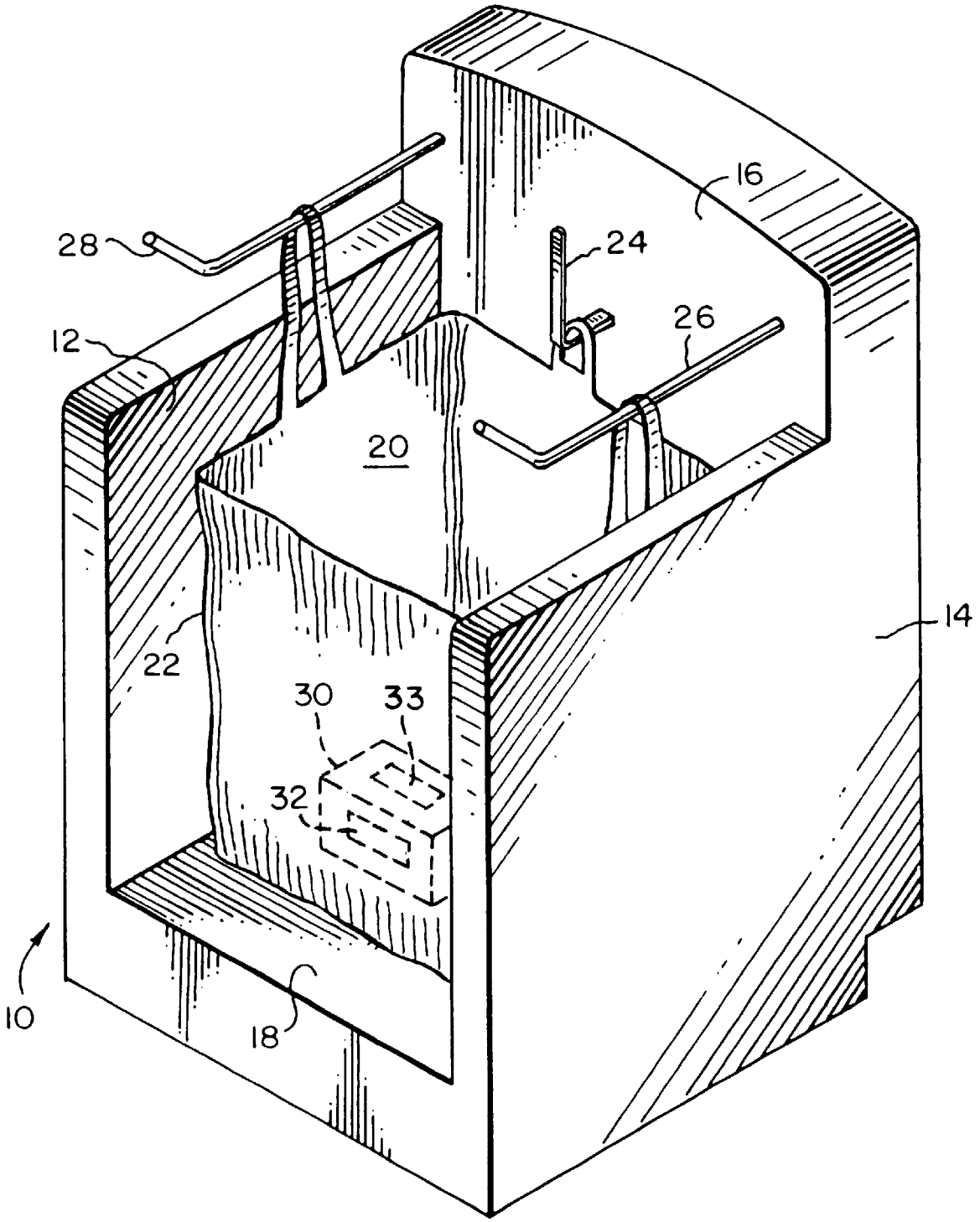
FIG. 1 is a perspective view of a bagging station having a data capture and EAS tag deactivation system according to one embodiment of the present invention.

Referring to FIG. 1, a bagging station 10 incorporating a data capturing and EAS deactivation system according to one embodiment of the present invention is shown. Bagging station 10 has three sidewalls 12, 14, and 16 and a bottom 18 that define a volume 20 in which a shopping bag 22 or other bulk container can be placed. A quantity of plastic shopping bags can be placed on bulk holder 24 with their handles on bag racks 26 and 28 and then pulled out for use one at a time. Bulk holder 24 and bag racks 26 and 28 are mounted on sidewall 16. Shopping bag 22 contains article 30 which has an associated EAS tag 32 for use with an EAS system as is known in the art and a transponder tag 33 that contains a radio frequency identification (RFID) chip and an antenna. The RFID chip of transponder tag 33 has a memory that can contain data that identifies the article and the pricing of the article as well as other information to assist in the point of sale transaction, and inventory control. Preferably EAS tag 32 is a magnetoacoustic EAS tag sold by the assignee of this application under the brand name "ULTRA●MAX®", such EAS tags are used widely for theft deterrence.

Figure 2:
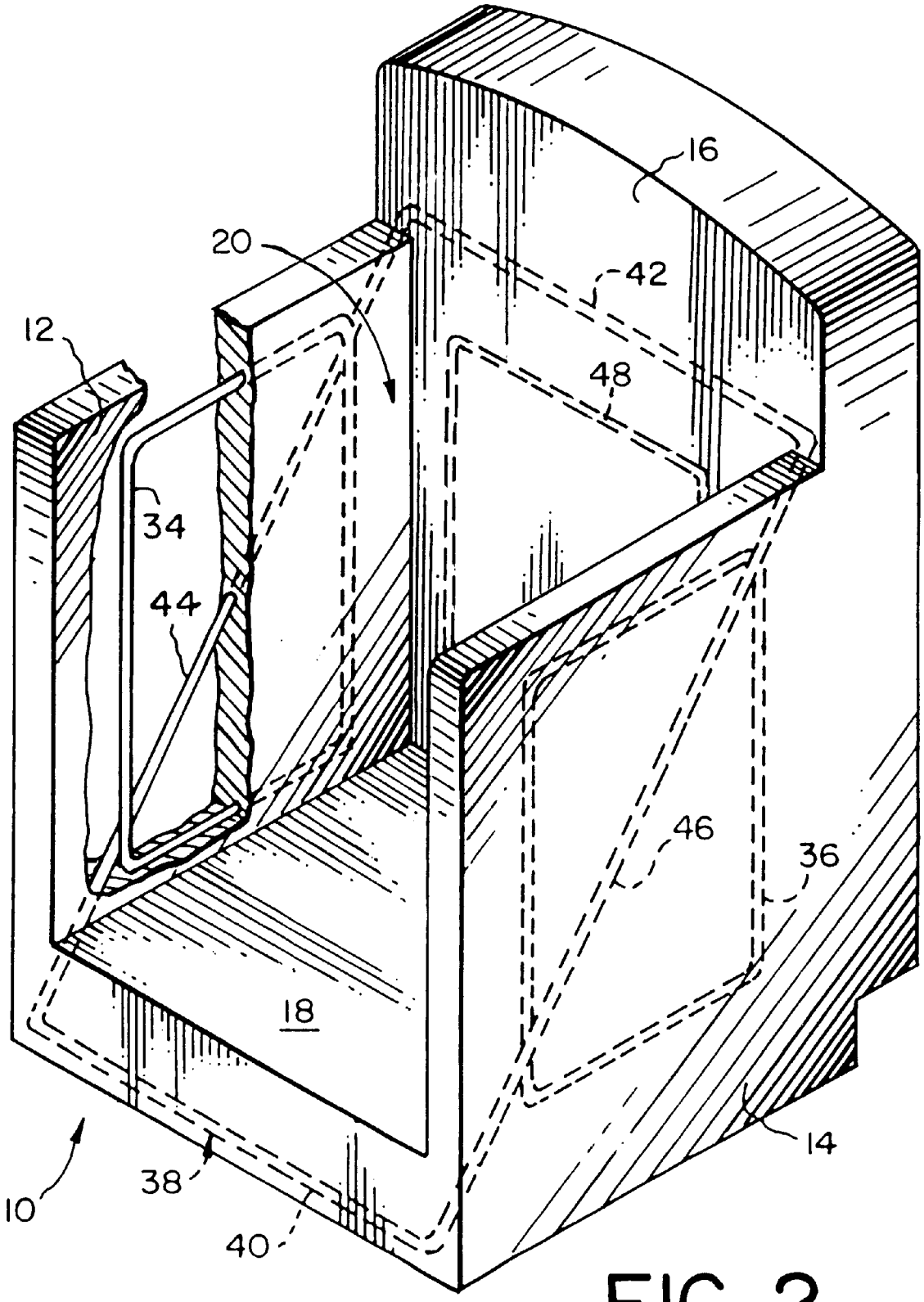
FIG. 2 is a perspective partially cut away view showing one embodiment of the deactivation coils and transponder interrogation antenna in the bagging station of FIG. 1.

FIG. 2 shows a deactivation coil and transponder antenna arrangement of the present invention for use with bagging station 10. Deactivation coil 34 is located inside sidewall 12, and deactivation coil 36 is located inside sidewall 14. Sidewalls 12 and 14 are parallel so that deactivation coils 34 and 36 are located in parallel planes. Deactivation coil 38 has four coil sections 40, 42, 44, and 46. Coil section 40 is located in bottom 18 near the front portion thereof, and coil section 42 is located in sidewall 16 near the top portion thereof Coil sections 44 and 46 are located in sidewalls 12 and 14 respectively along the approximate respective diagonals of deactivation coils 34 and 36. A power supply energizes deactivation coils 34, 36, and 38 to create the magnetic fields to deactivate EAS tag 32. Antenna 48 for interrogating transponders located in a predetermined area, such as volume 20, captures the data about article 30 that is contained in transponder tag 33.

Figure 3:
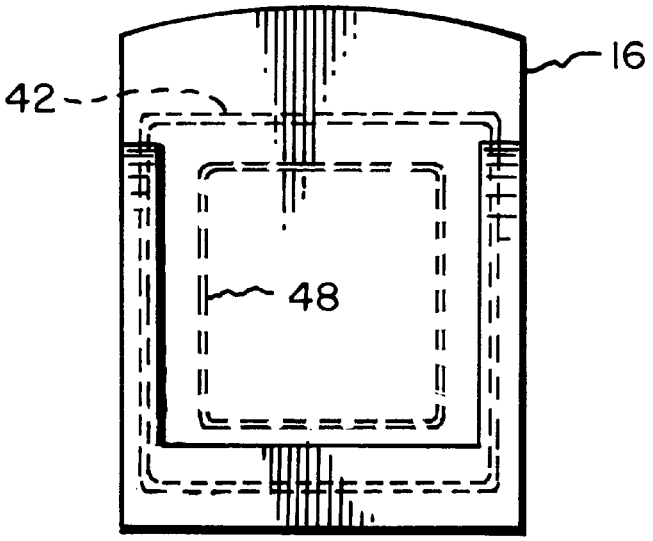
FIG. 3 is a diagram showing one embodiment of an EAS deactivation coil and transponder interrogation antenna.

FIG. 3 illustrates diagrammatically one embodiment of an EAS deactivation coil and transponder interrogation antenna in a sidewall of the system shown in FIGS. 1 and 2. Coil section 42 of deactivation coil 38 is located near the top portion of sidewall 16 as illustrated in FIGS. 1 and 2. Interrogation coil 48 can be a simple loop antenna as shown or it can comprise alternate configurations as is known in the art.

Figure 5:
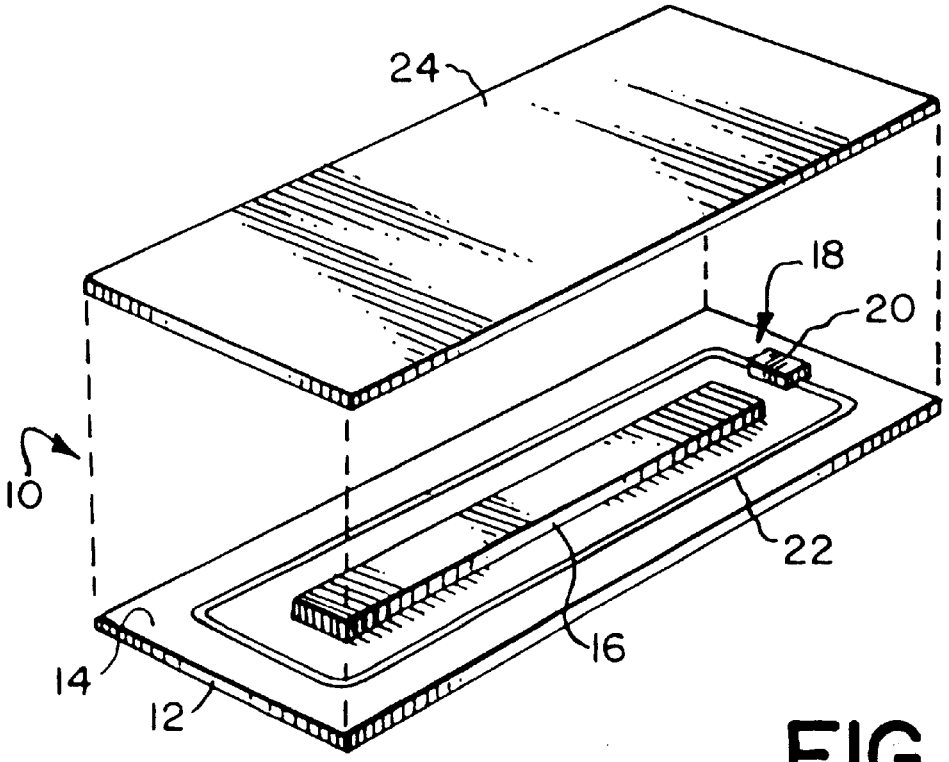
FIG. 5 illustrates a preferred embodiment of an integrated tag for use with the present invention.
Figure 4:
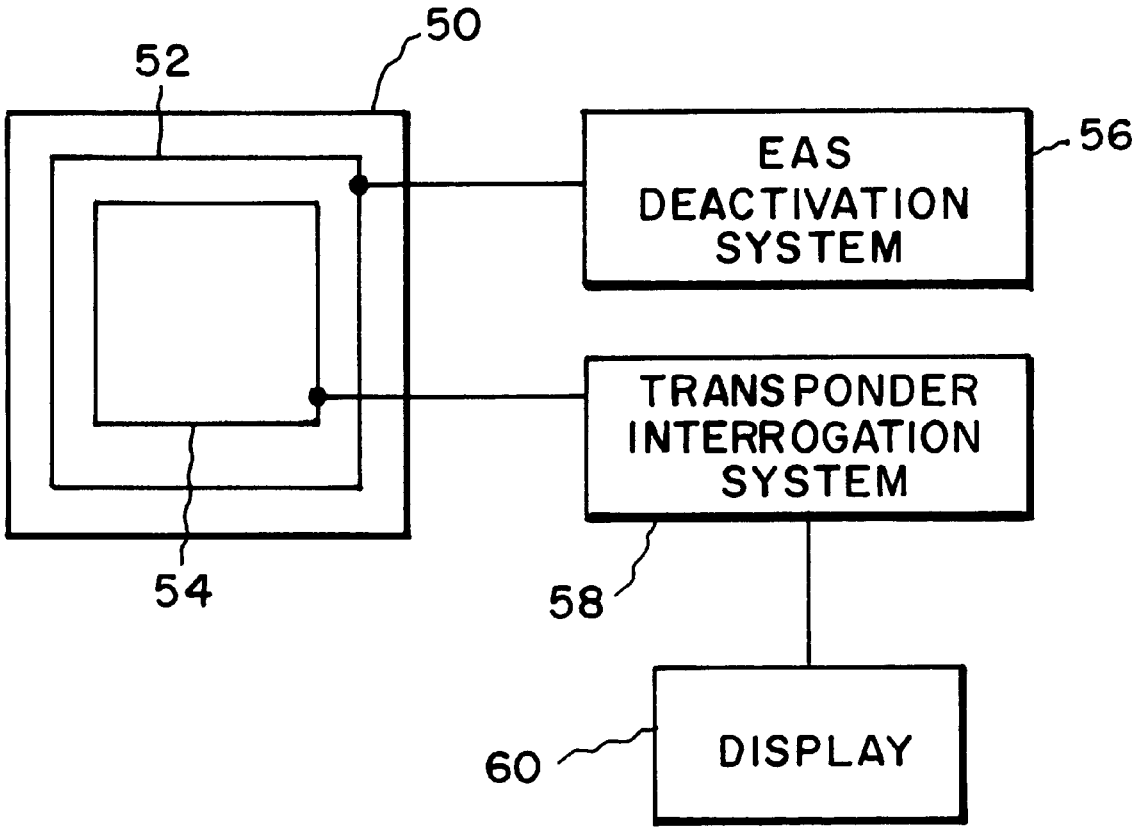
FIG. 4 shows an alternative embodiment of the present invention.

FIG. 4 shows an alternative embodiment of the present invention in which the EAS deactivation coil and the transponder coil are positioned in a pad or housing 50, such as the deactivation pad marketed by the assignee of this invention under the brand name "Rapid Pad™". EAS deactivation coil 52 is located inside housing 50, and transponder interrogation antenna 54 is also positioned inside housing 50. As shown antenna 54 is positioned inside of deactivation coil 52; however, other configurations are possible, for example, antenna 54 can be located outside of deactivation coil 52 or antenna 54 and deactivation coil 54 can overlap. Deactivation coil 52 is actuated by EAS deactivation system 56 as is known in the art. Antenna 54 is connected to transponder interrogation system 58 which provides the appropriate interrogation signals, as is known in the art, to a transponder positioned in a predetermined area, such as an area above housing 50, to gather information about the article being checked out and then use such information for the transaction at the point of sale. In addition, transponder interrogation system 58 can provide or write information to the transponder. This information can include the date and place of sale, the selling price, and manufacturer for authenticity of the article. The information can be displayed on display 60 which can be a monitor, cash register display or other suitable display. In addition, transponder interrogation system 58 can store such information for inventory control or other uses. Referring to FIG. 5, a preferred embodiment of a multifunction tag 110 for use with the present invention is shown. A bottom cover 112, such as a substrate or film, has an upper surface 114 on which EAS tag 116 is positioned. A transponder 118 comprising an RFID chip 120 and an antenna 122 attached to RFID chip 120 are positioned on surface 114 such that antenna 122 is located around EAS tag 126. RFID chip 120 contains logic and memory as is known in the art, and the memory can contain data about the article to which it will be attached. This data can include identification of the article, the price of the article, and inventory control information. A cover 124, such as a film or mylar, covers EAS tag 116 and transponder 118. The surface of cover 124 which contacts surface 114, EAS tag 116, and transponder 118 can also have an adhesive to assist in bonding the parts together. Cover 112 can comprise a housing that has a cavity that is sized to accommodate transponder 118 and a another cavity that is sized to accommodate EAS tag 116.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An apparatus for use with articles having associated data transponders and associated electronic article surveillance tags, said apparatus comprising: a housing defining a volume in which a bag can be placed for packaging said articles, said housing having an open side for removal of said bag and an open top; a plurality of deactivation coils positioned in said housing for simultaneously deactivating said electronic article surveillance tags when said articles are in said volume; and a data communication system comprising an antenna positioned in said housing for communicating with said data transponders when said articles are in said volume.

2. An apparatus as recited in claim 1, wherein said data transponders have data stored about said articles with which said data transponders are associated and said data communication system gathers the stored data from said data transponders when said articles are in said volume.

3. An apparatus as recited in claim 2, wherein said data gathered from said data transponders comprises at least one of the selling prices of said articles, identification of said articles, and the manufacturers of said articles.

4. An apparatus as recited in claim 3, further comprising a display connected to said data communication system and wherein said data communication system provides the gathered data to said display.

5. An apparatus as recited in claim 1, wherein said data communication system can transmit data to said data transponders when said data transponders are in said volume and said data transponders can receive and store data transmitted from said data communication system.

6. An apparatus as recited in claim 5, wherein said data transmitted by said data communication system comprises at least one of the date of sale of said articles, the place of sale of said articles, and the selling prices of said articles.

7. An apparatus as recited in claim 2, wherein said data communication system can transmit data to said data transponders when said data transponders are in said volume and said data transponders can receive and store data transmitted from said data communication system.

8. An apparatus as recited in claim 7, wherein said data transmitted by said data communication system comprises at least one of the date of sale of said articles, the place of sale of said articles, and the selling prices of said articles.

9. An apparatus as recited in claim 1, wherein said plurality of deactivation coils comprises three deactivation coils.

10. An apparatus as recited in claim 9, wherein a first deactivation coil of said three deactivation coils is positioned in a first wall of said housing, a second deactivation coil of said three deactivation coils is positioned in a second wall of said housing, and a third deactivation coil of said three deactivation coils is positioned in said housing such that said third deactivation coil intersects said first and second deactivation coils at an angle that is greater than zero degrees and less than ninety degrees.

11. An apparatus as recited in claim 10, wherein said first and second walls are opposite each other and said antenna for communicating with said data transponders is positioned in a wall located between said first and second walls.

12. An apparatus as recited in claim 11, wherein said third deactivation coil is collinear with a diagonal of said first and second deactivation coils.

13. An apparatus as recited in claim 12, wherein said first and second walls are parallel.

14. An apparatus as recited in claim 13, wherein said data transponders have data stored about said articles with which said data transponders are associated and said data communication system gathers the stored data from said data transponders when said articles are in said volume.

15. An apparatus as recited in claim 14, wherein said data gathered from said data transponder comprises at least one of the selling prices of said articles, identification of the articles and the manufacturers of said articles.

16. An apparatus as recited in claim 15, further comprising a display connected to said data communication system and wherein said data communication system provides the gathered data to said display.

17. An apparatus as recited in claim 13, wherein said data communication system can transmit data to said data transponders when said data transponders are in said predetermined area and said data transponders can receive and store data transmitted from said data communication system.

18. An apparatus as recited in claim 17, wherein said data transmitted by said data communication system comprises at least one of the date of sale of said articles, the place of sale of said articles, and the selling prices of said articles.

19. An apparatus as recited in claim 14, wherein said data communication system can transmit data to said data transponders when said data transponders are in said predetermined area and said data transponders can receive and store data transmitted from said data communication system.

20. An apparatus as recited in claim 19, wherein said data transmitted by said data communication system comprises at least one of the date of sale of said articles, the place of sale of said articles, and the selling prices of said articles.

* * * * *